United States Patent [19]

Region

[11] 4,374,532

[45] Feb. 22, 1983

[54] WOOD SPLITTING DEVICE

[76] Inventor: James A. Region, Rte. 2, Box 143BX, Sheridan, Ill. 60551

[21] Appl. No.: 257,823

[22] Filed: Apr. 27, 1981

[51] Int. Cl.[3] ..... B27L 7/00

[52] U.S. Cl. ..... 144/193 A; 144/193 R

[58] Field of Search ..... 144/2 N, 193 R, 193 A, 144/366

[56] References Cited

U.S. PATENT DOCUMENTS

| | | | |
|---|---|---|---|
| 3,780,779 | 12/1973 | Guy | 144/193 A |
| 4,073,325 | 2/1978 | Krom, Jr. | 144/193 A |
| 4,111,246 | 9/1978 | La Pointe | 144/193 A |
| 4,164,965 | 8/1979 | Bodart | 144/193 A |

*Primary Examiner*—W. D. Bray

*Attorney, Agent, or Firm*—Ernest S. Kettelson

[57] ABSTRACT

A wood splitting device for attachment to the hydraulic cylinder of a tractor mounted end loader, comprising an elongated work table on which a log or other piece of wood is placed, a splitting wedge member at one end of the work table surface, a ram head connected to the piston of the hydraulic cylinder after disconnection from the end loader bucket to press the log against the wedge member causing it to split, the ram head including inturned guide arms extending downwardly from opposite sides of its base and inwardly to seat in longitudinal grooves along opposite sides of the elongated work table and beneath the surface thereof to hold the ram head on the work table surface as it is moved from a retracted position to an extended position by operation of the hydraulic cylinder, the work table being held in position by a frame member rigidly connected to one arm member of the end loader.

20 Claims, 10 Drawing Figures

WOOD SPLITTING DEVICE

BACKGROUND OF THE INVENTION

This invention relates to the field of wood or log splitters for attachment to pre-existing hydraulic or other power sources, such as the hydraulic systems of many modern farm tractors and the like.

There are a number of log splitting devices already known in this general field, including those disclosed in the following U.S. Pat. Nos. 4,155,385; 4,111,245; 4,073,325; 4,019,549; 3,814,152; 3,780,779; 3,760,854; 3,721,281; 3,461,927; 3,319,675; 3,280,864; 2,966,180; 2,820,493. There are certain similarities between the log or wood splitting and cutting devices of those prior art patents and the subject invention of this application, but there are a number of differences and improvements in the present invention over the prior art which will become obvious as the invention is described in detail herein below.

The present invention is particularly well adapted for use with tractors having hydraulic powered end loaders of the type which use two hydraulic cylinders to manipulate the bucket, one on each side. With such tractors, the bucket is tipped over as far as it will go by extension of the hydraulic cylinder rams and lowered to the ground with the bucket in substantially an upside-down position. The ram of one hydraulic cylinder is disconnected from the bucket at one side, leaving the one on the other side of the bucket still connected. The frame of the log splitting device in accordance with this invention is then attached to the bucket at the previous hydraulic cylinder connection and to the corresponding arm of the end loader in such a way that the frame of the log splitting device prevents the end loader bucket from pivoting relative to the end loader arm. In this way, the opposite hydraulic cylinder which is still connected to the end loader bucket in the extended position is kept immobilized (since the bucket cannot pivot while the frame of the log splitting device is connected at the other side to both the end loader arm and end loader bucket to hold them rigid relative to each other). By keeping the opposite side hydraulic cylinder immobilized in the extended position, the full force of the tractor's hydraulic system is thereupon diverted to the other hydraulic cylinder which is now connected to the ram head of the log splitting device for reciprocal movement toward and away from the splitting wedge member. In this way, the speed of such reciprocal movement is increased and the force exerted by the hydraulic cylinder connected to the log splitting device is increased over what it would be if the opposite side hydraulic cylinder were free to also move forward and backward.

The tipped-over bucket of the end loader resting on the ground provides a solid base for the log splitting device in accordance with this invention to rest on while log splitting operations are conducted.

SUMMARY OF THE INVENTION

It is an object of the invention to provide a log or wood splitting device for attachment to a machine having a hydraulic or other power source to drive a reciprocating arm, in which the log splitting device may be readily attached and detached.

It is an object of the invention to provide a log or wood splitting device having a ram head movable reciprocally toward and away from a splitting wedge member, in which the ram head is attachable to a reciprocating power source of a machine and the wedge member is rigidly mountable on said machine in alignment with the reciprocal movement of said ram head and spaced from said ram head to split logs or pieces of wood placed between said ram head and said wedge member as the ram head is moved toward the wedge member.

It is an object of the invention to provide a log or wood splitting device having a ram head movable reciprocally toward and away from a splitting wedge member, in which the ram head is attachable to the reciprocating piston rod of a hydraulic cylinder of a tractor mounted implement such as an end loader after the said rod has been disconnected from said implement and the wedge member is rigidly mountable on a part of said implement in alignment with the reciprocal movement of said ram head.

DESCRIPTION OF PREFERRED EMBODIMENT

Figure 1:
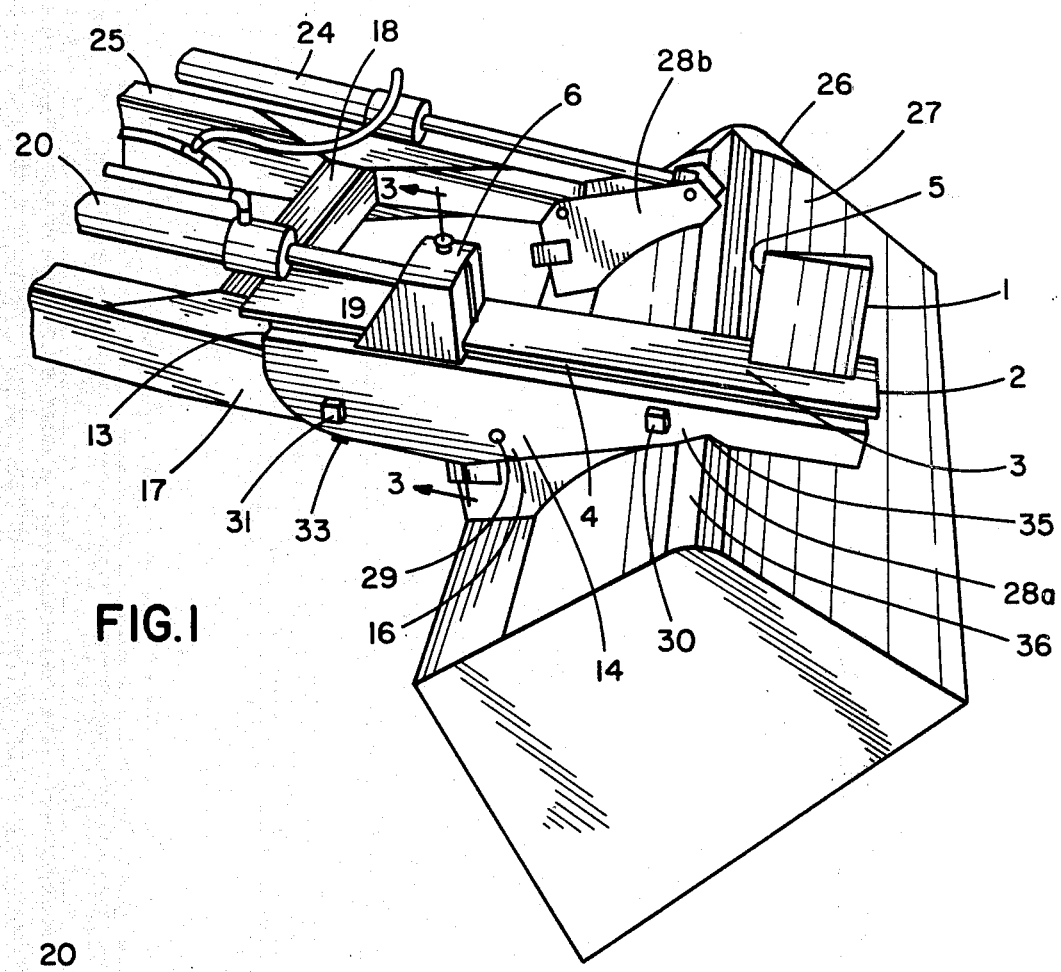
FIG. 1 is a perspective view of a log splitting device in accordance with this invention attached to a tractor mounted end loader and connected to its hydraulic power source.
Figure 2:
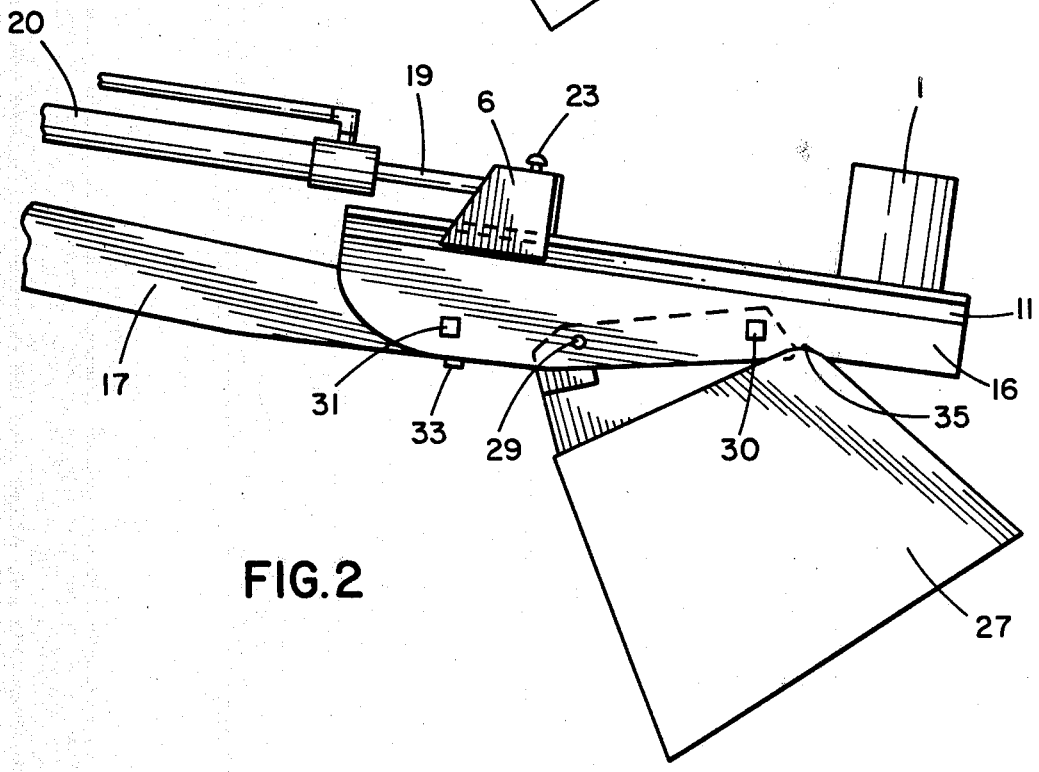
FIG. 2 is a side elevation view of the log splitting device of FIG. 1 showing the ram head in its retracted position.
Figure 4:
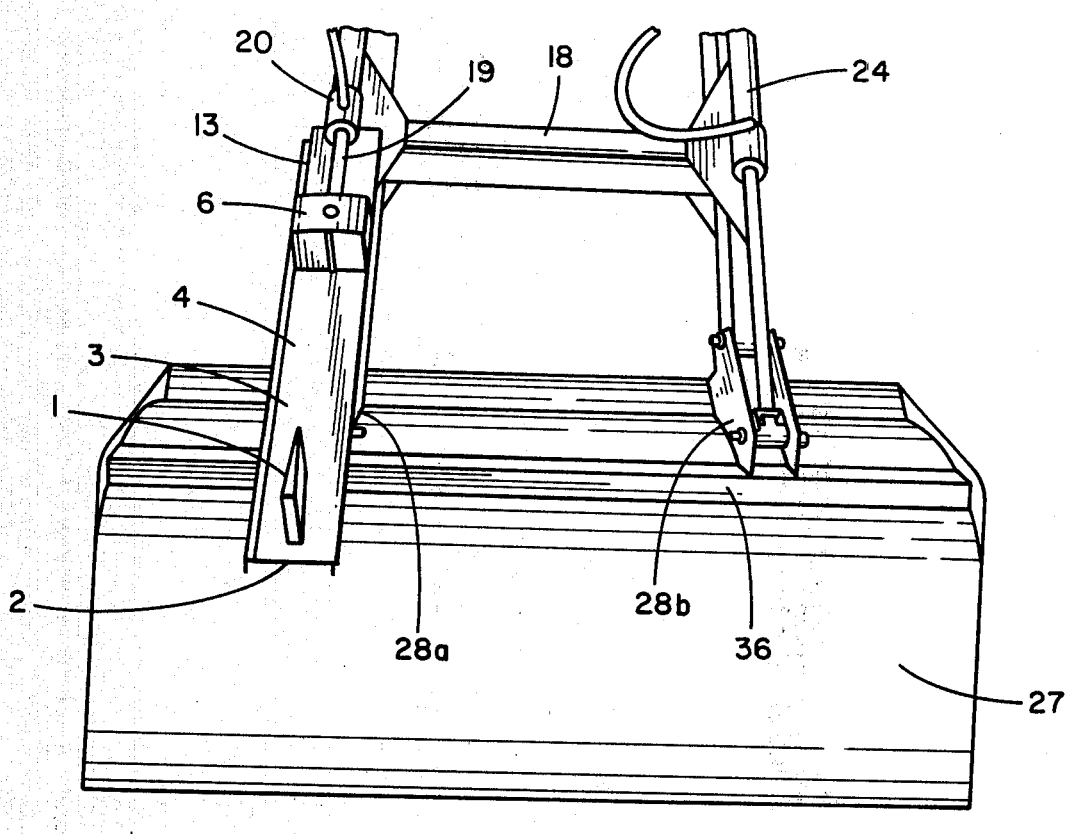
FIG. 4 is a frontal elevation view of the log splitting device and tractor mounted end loader of FIG. 1.
Figure 3:
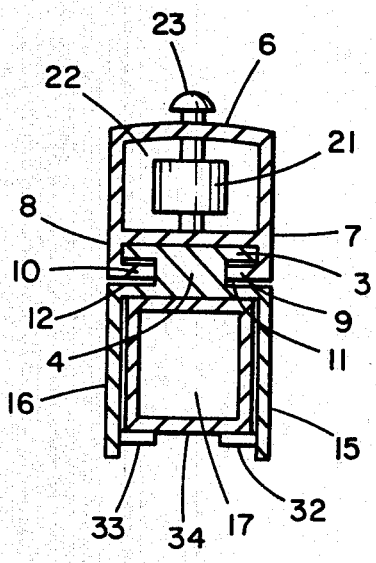
FIG. 3 is a section view taken on line 3—3 of FIG. 2.
Figure 5:
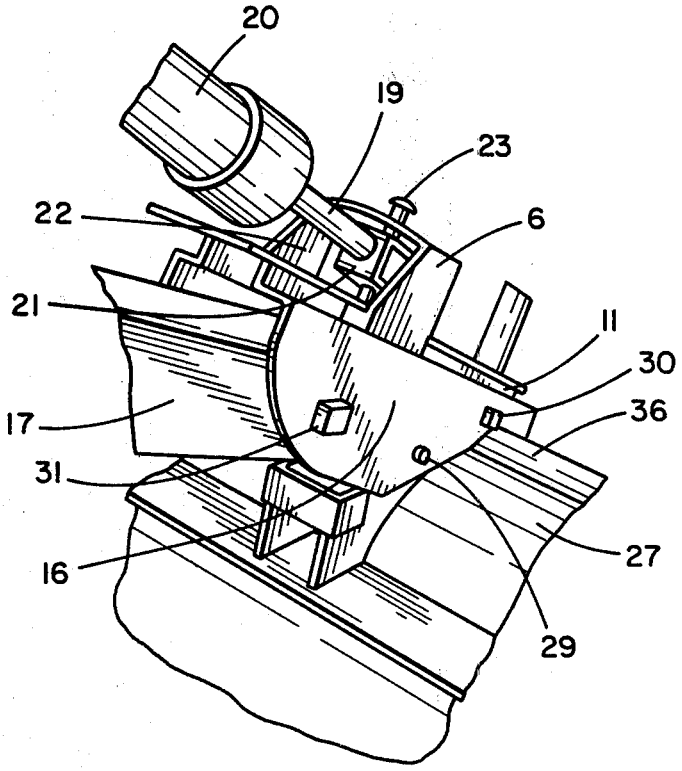
FIG. 5 is an enlarged perspective view from the rear of the log splitting device in accordance with this invention.
Figure 6:
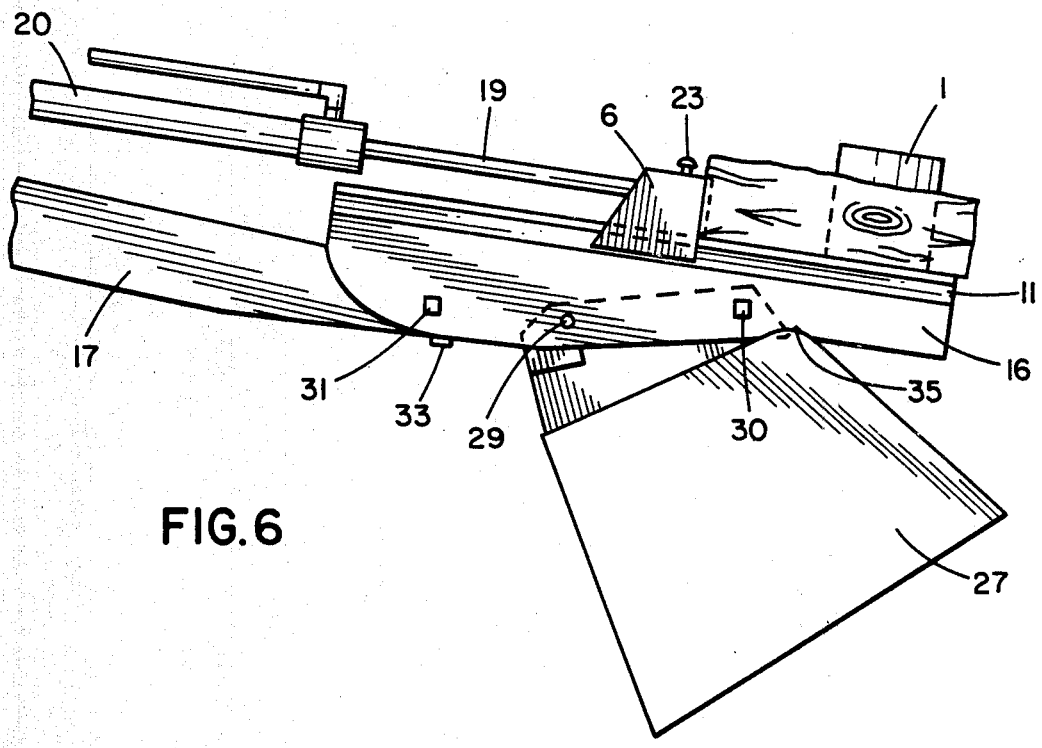
FIG. 6 is a side elevation view of the log splitting device of FIG. 2 but with the ram head in its extended position and showing a log being split.
Figure 7:
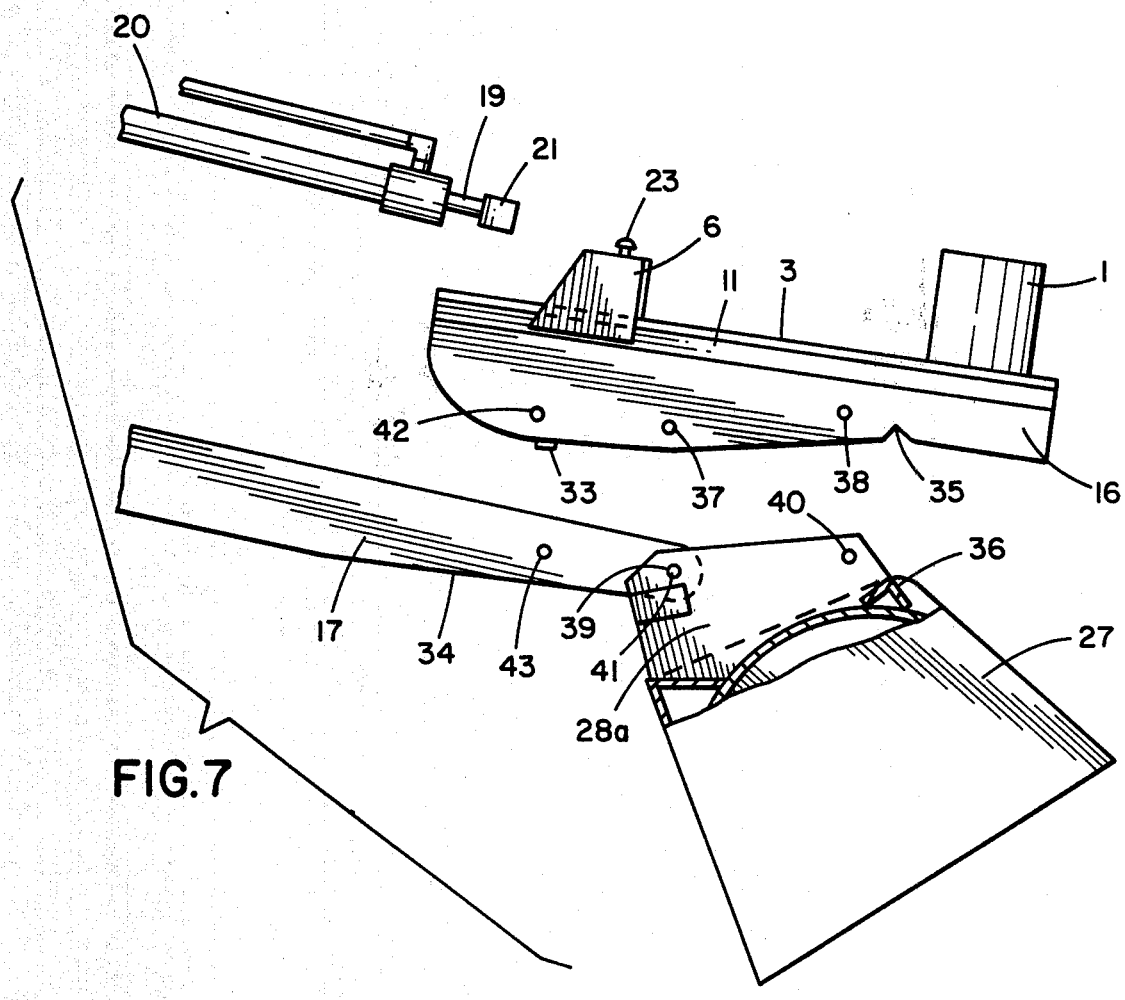
FIG. 7 is a side elevation view showing the log splitting device of FIG. 2 positioned above the end loader arm and bucket connecting bracket prior to seating thereon.

A log or wood splitting device in accordance with this invention includes a splitting wedge member 1 extending upright from one end 2 of the planar platform or work surface 3 of an elongated work table 4.

The wedge member 1 has a cutting edge 5 extending upwardly at substantially a right angle to the planar work surface 3, the wedge member 1 and its cutting edge 5 being positioned on the median line or longitudinal axis of the work surface 3 at its end region 2 with the cutting edge 5 facing the reciprocating ram head 6.

The ram head 6 is mounted on the elongated work table 4 for sliding reciprocal movement along the planar work surface 3 toward and away from the cutting edge 5 of the wedge member 1. The ram head 6 includes a pair of depending arms 7 and 8, depending from opposite sides to straddle the platform or work surface 3 of elongated work table 4. A pair of guide members 9 and 10 are integrally formed with and extend inwardly from depending arms 7 and 8 respectively at substantially right angles. The guide members 9 and 10 seat in respective longitudinal grooves 11 and 12 which extend respectively along each opposite side of the elongated work table 4 from the forward end 2 to the rearward end 13. The guide members 9 and 10 slide within the respective longitudinal grooves 11 and 12 when the ram head 6 is moved reciprocally toward and away from the wedge member 1, thereby keeping the ram head 6 properly aligned on the work surface 3 with the cutting edge 5 of the wedge member 1.

The elongated work table 4 is integrally formed with and extends above the frame 14 of the log or wood splitting device.

The frame 14 includes a pair of spaced apart side walls 15 and 16 which depend downwardly from the elongated work table 4 and which straddle one of the extending booms or arms 17 of a tractor mounted end loader 18 when the log splitting device is mounted thereon.

When the log splitting device is mounted on the arm 17 of the end loader 18, the ram head 6 is connected to the reciprocating ram or piston rod 19 of the hydraulic cylinder 20 of the end loader 18 by inserting the coupling head 21 of the rod 19 into a rearward opening recess 22 of ram head 6 and dropping a coupling pin 23 through an aperture in the top of ram head 6, through a corresponding aperture in coupling head 21 of piston rod 19 and seating in a pocket in the bottom of the recess 22 of ram head 6. When the reciprocating ram or piston rod 19 is moved forwardly and rearwardly by operation of the hydraulic cylinder 20, the ram head 6 is correspondingly moved forwardly and rearwardly along the elongated planar work surface 3 toward and away from the wedge member 1.

The end loader 18 includes a second hydraulic cylinder 24 extending along and above a second boom or arm 25 of the end loader 18 which connects to one side region 26 of the bucket 27. This second hydraulic cylinder 24 remains connected to the bucket 27, but the other hydraulic cylinder 20 and its reciprocating ram or piston rod 19 are disconnected from the bucket 27 when the log splitting device is to be connected.

When the piston rod 19 is disconnected from the bucket 27, the frame 14 of the log splitting device is placed on the end loader arm 17 with its side walls 15 and 16 straddling the arm 17 along its forward end region, the side walls 15 and 16 extending forwardly thereof to also straddle the connecting bracket 28*a* of end loader bucket 27.

A connecting bolt 29 is placed through corresponding holes in the middle portion of side walls 15 and 16 of mounting frame 14 of the log splitting device, through a bore in the forward end of the end loader arm 17, as well as through apertures in the rearward portion of the connecting bracket 28*a*.

A second connecting bolt 30 is placed through corresponding holes in the forward portion of side walls 15 and 16 of frame 14 and through apertures in the forward portion of the bucket connecting bracket 28*a*.

The frame 14 of the log splitting device is thereupon securely and rigidly connected to both the front and rear portions of the bucket connecting bracket 28*a*, and to the end loader arm 17. A third bolt 31 may be placed through apertures through the end loader arm 17 rearwardly from the forward end thereof and through corresponding apertures in the side walls 15 and 16 of frame 14. In this way, the frame 14 of the log splitting device holds the bucket 27 rigid relative to the end loader arm 17 preventing it from pivoting on the end of the end loader arm 17 as it would otherwise be able to do. The bucket is held rigid even though the second hydraulic cylinder 24 had not been disconnected from the connecting bracket 28*b* on the other side of the bucket 27.

In lieu of the third connecting bolt 31, a pair of inturned flanges 32 and 33 can be provided along the bottom edge of side walls 15 and 16 near the rearward end region 13 of said side walls and extending inwardly therefrom respectively at substantially right angles. The side walls 15 and 16 extend downwardly far enough to extend slightly beyond the bottom edge 34 of the end loader arm 17, whereby the inturned flanges 32 and 33 bear against the bottom edge 34 of the arm 17 when the frame 14 of the log splitting device is mounted thereon. This construction, comprising the flanges 32 and 33 bearing against the bottom edge 34 of end loader arm 17 near the rearward end region 13 of the log splitter frame 14, plus the connecting bolts 29 and 30 in place as previously described, will also hold the bucket 27 rigid relative to the end loader arm 17 even though the other hydraulic cylinder 24 is still connected to the other side of the bucket 27.

By so holding the bucket 27 rigid, the entire pressure of the hydraulic system is diverted from the second hydraulic cylinder 24 (which is still connected to the bucket 27 and hence immobilized) to the first mentioned hydraulic cylinder 20 which is now connected to the ram head 6 of the log splitting device. This causes the cylinder 20 to have increased power, and to reciprocate its piston rod 19 with increased speed forward and backward, greater power and speed than if the opposite cylinder 24 were disconnected and not immobilized but left free to also move its piston rod at the same time as cylinder 20 reciprocates rod 19.

The log splitting device in accordance with this invention may be readily attached and detached to a tractor mounted end loader. Only two bolts 29 and 30 are required for the modification which includes inturned flanges 32 and 33 to bear against the bottom edge 34 of the end loader arm 17, and only three bolts 29, 30 and 31 in the modification in which bolt 31 extends through end loader arm 17 and the rear portions of side walls 15 and 16 of the log splitting device frame 14.

Figure 8:
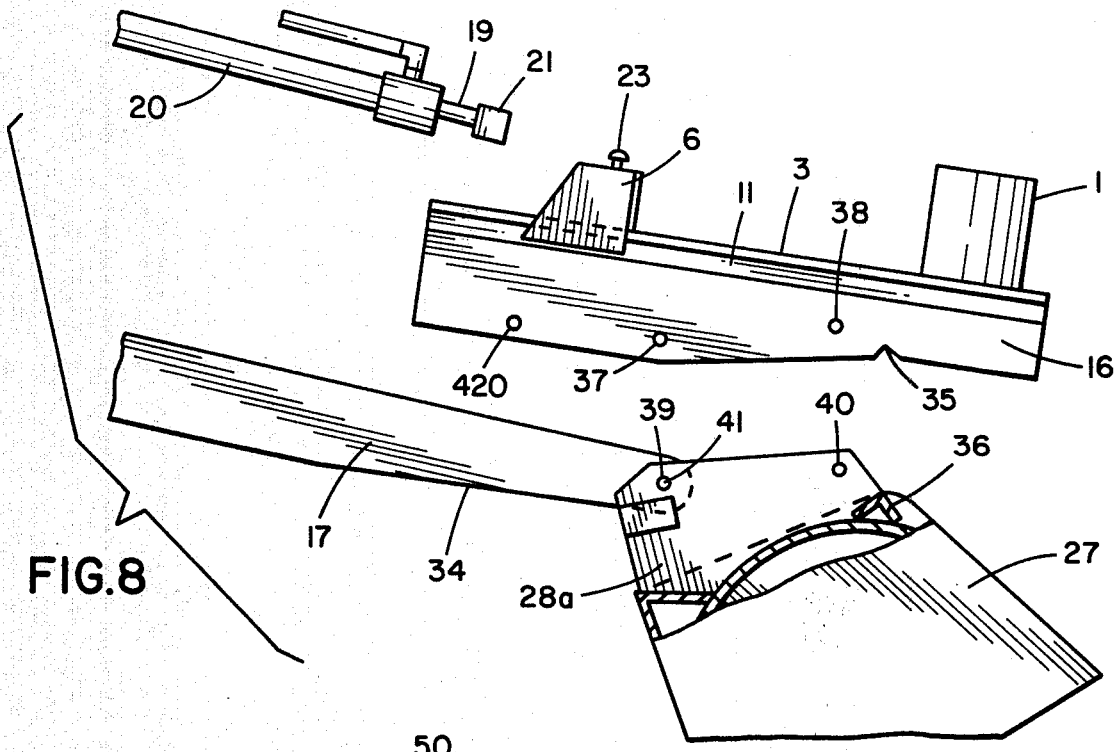
FIG. 8 is a side elevation view showing a modified version of the log splitting device in accordance with this invention positioned above the end loader arm and bucket connecting bracket prior to seating thereon.

In lieu of inturned flanges 32 and 33, another modification is shown in FIG. 8 in which the side walls 15 and 16 are extended downwardly at the rearward end region 13 to extend beyond the bottom edge 34 of the end loader arm 17 when the log splitting device is mounted thereon. A pair of apertures 420 are provided in side walls 15 and 16 respectively, in alignment with each other and positioned immediately below and adjacent the plane of the bottom edge 34 of the end loader arm 17. The stabilizing bolt or pin 31 is then placed through the pair of apertures 420, whereupon its shank abuts against the bottom edge 34 of the end loader arm 17 to hold the log splitting device in place together with connecting bolts or pins 29 and 30. In this modification, the additional hole 43 through end loader arm 17 is not necessary.

Figure 9:
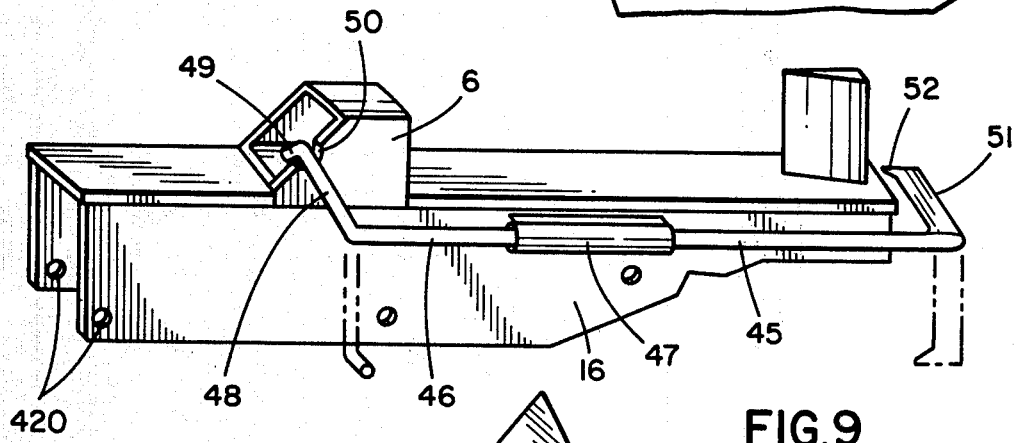
FIG. 9 is a perspective view of the log splitting device in accordance with this invention illustrating a log dislodging assembly mounted thereon in operable position, showing the out of engagement and inoperable position of said log dislodging assembly in phantom with broken lines indicating such position.

FIG. 9 illustrates a further modification of this invention which includes a log dislodging device 45. The log dislodging device 45 is slidingly mounted along side wall 16 of the log splitter frame 14, and includes an elongated shaft 46 slidingly mounted in a tubular bracket 47 attached to side wall 16, which has a connecting arm 48 extending at substantially a right angle from one end of the elongated shaft portion 46 to connect with the ram head 6 for powered rearward movement of the log dislodging device 45. The connecting arm 48 includes a hook end portion 49 which seats in a connecting recess 50 formed in a rear wall portion of the ram head 6. The opposite end of the elongated shaft 46 includes a dislodging arm 51 which extends at substantially a right angle from said opposite end in substantially the same plane and same direction as the connecting arm 48 extends from the other end. The dislodging arm 51 includes a projecting lance portion 52 with its piercing end facing rearwardly toward the ram head 6. The dislodging arm 51 extends from the elongated shaft 46 a distance which is just short of wedge member 1. The lance 52 engages the forward end of a log when it becomes stuck on the wedge member 1 and cannot be dislodged without the use of hydraulic or other than manual power. At such time, the hook 49 of the connecting arm 48 is seated in the connecting recess 50 along the rear wall portion of ram head 6. Thus, when hydraulic pressure is applied to the hydraulic cylinder 20 in the rearward direction, the ram head draws the log dislodging device 45 rearward, the lance portion 52 of dislodging arm 51 engaging the forward end of a log stuck on the wedge member 1 and forcibly moving rearwardly to separate the log from the wedge member 1. When not in use, the shaft 46 of the dislodging device 45 may be rotated within the tubular bracket 47 thus pivoting the connecting arm 48 and dislodging arm 51 from its connected operable position to a disconnected inoperable position in which the connecting arm 48 hangs downwardly along the side wall 16 of the frame 14 and the dislodging arm 51 also hangs downwardly in similar fashion near the forward portion of the log splitting device, as shown in phantom by broken lines in FIG. 9.

In operation, the log splitting device is attached to a tractor mounted end loader as follows. The end loader bucket 27 is first manipulated to its completely tipped over position and then lowered to the ground by operation of the tractor's hydraulic system. The coupling end 21 of the reciprocating ram 19 of one of the hydraulic cylinders, such as hydraulic cylinder 20, is then disconnected from the forward end of bucket connecting bracket 28*a*. The bolt which connects end loader arm 17 to the rearward end of bucket connecting bracket 28*a* is next removed. The log splitting device is placed on the end loader arm 17 with the rearward portion of side walls 15 and 16 straddling end loader arm 17 and the forward intermediate portion straddling the forward portion of bucket connecting bracket 28*a*. A pair of notches 35 may be formed in the bottom edges of side walls 15 and 16 near the forward end 2 seat on the angled forward corner edge 36 of the overturned bucket 27. These notches 35 are so positioned that when seated in the forward corner edge 36 of the overturned bucket 27, the mounting holes 37 and 38 of the log splitting device are in registration respectively with the rearward holes 39 and forward holes 40 of the bucket connecting bracket 28*a*. Connecting bolt 29 is then placed through mounting holes 37 of the side walls 15 and 16 of the log splitting device and rearward holes 39 of the connecting bracket 28*a*, as well as through the connecting hole 41 through the forward end of end loader arm 17. Connecting bolt 30 is next placed through mounting holes 38 of side walls 15 and 16 of the log splitting device and through forward holes 40 of the connecting bracket 28*a*. The stabilizing bolt 31 is placed through stabilizing holes 42 near the rearward end 13 of side walls 15 and 16 of the log splitting device and through hole 43 extending through end loader arm 17, to stabilize and rigidify the mounting of the log splitting device of this invention to immobilize and hold the end loader arm 17 and bucket 27 from relative rotational movement with respect to each other. Alternatively, in the modification shown in FIG. 8 the bolt or pin 31 is placed through the holes 420 below the bottom edge 34 of end loader arm 17.

The coupling end 21 of the hydraulic cylinder reciprocating ram 19 is then placed into the rearward opening recess 22 of the ram head 6 of the log splitting device, with the hole in coupling end 22 in registration with corresponding connecting holes or apertures through the top and in the bottom of the ram head 6. A coupling pin 23 is then dropped in place through such holes to couple the hydraulic cylinder reciprocating ram or piston rod 19 to the ram head 6 of the log splitting device.

The log splitting device is now operatively connected to the tractor mounted end loader and the bucket 27 is held in an immobilized position even though the other hydraulic cylinder 24 is still connected to the bucket 27.

Figure 10:
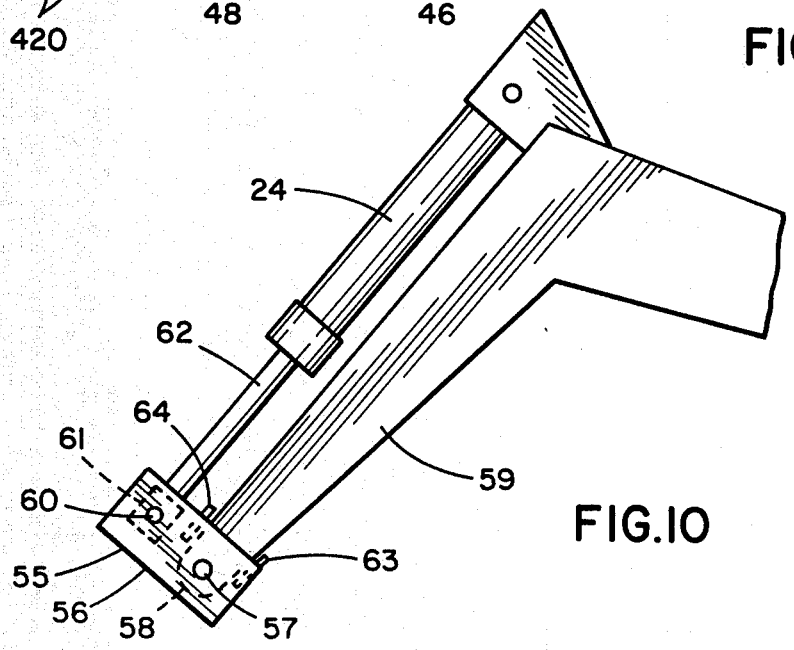
FIG. 10 is a side elevation view of a locking device to immobilize one of the hydraulic cylinders of an end loader with which the log splitting device of this invention is used.

The log splitter device of this invention may also be used with the bucket 27 of the end loader completely removed. In that case a locking device 55 is provided for hydraulic cylinder 24 which would remain connected to the bucket 27 when the log splitting device is used with the bucket still connected in part. The locking device 55 shown in FIG. 10 includes a rigid locking member 56 having a first aperture and pin assembly 57 for connection to the free end 58 of end loader arm 59 normally connected to connecting bracket 28*b* of the end loader bucket 27. The locking member 56 also includes a second aperture and pin assembly 60 for connection to the free end 61 of the reciprocating ram or piston rod 62 of hydraulic cylinder 24. The locking member 56 further includes a pair of rigidly connected, spaced apart retaining plates 63 and 64 to bear against the lower and upper edges respectively of the end loader arm 59 when its free end portion 58 is connected to the aperture and pin assembly 57 of the locking member 56. In this way, the locking member 56 is held from pivotal movement about aperture and pin assembly 57 when connected to the end loader arm 59, and the piston rod 62 of hydraulic cylinder 24 is likewise then held immobilized when connected to the aperture and pin assembly 60 of the locking member 56. With the piston rod 62 of hydraulic cylinder 24 held immobilized by locking member 56, the entire hydraulic pressure of the hydraulic system is diverted to act on hydraulic cylinder 20 which is operably connected to the log splitter as described above, causing it to have increased power to reciprocate its piston rod 19 with increased speed forward and backward as well as with increased power applied to the ram head 6.

I claim:

1. A log splitting device for connection to a powered machine mounted implement which has at least one powered reciprocating arm to manipulate said implement, such reciprocating arm being disconnectible from said implement, said log splitting device including a mounting frame for connection to said powered machine mounted implement, log splitting means on said mounting frame in alignment with said one powered reciprocating arm when said log splitting device is connected to said powered machine mounted implement, said mounting frame including elongated track means extending along said mounting frame at a location between said log splitting means and said one powered reciprocating arm when said log splitting device is connected to said powered machine mounted implement, a ram head slidingly and captively mounted on said track means for reciprocal movement between a retracted position away from said log splitting means and an extended position toward said log splitting means, said ram head being connected to said one powered reciprocating arm to drive said ram head between said retracted and said extended positions, wherein said powered machine mounted implement is a tractor mounted end loader having a pair of extending lifting arms connected to a bucket for raising and lowering said bucket, said end loader including a pair of hydraulically powered reciprocating arms each positioned in spaced apart relationship with respective ones of said pair of lifting arms and each connected to said bucket to pivot said bucket on said lifting arms between a turned-upright and a turned-over position, said one powered reciprocating arm being one of said pair of hydraulically powered reciprocating arms, and rigid immobilizing connecting means to rigidly connect said mounting frame of said log splitting device to one of said lifting arms and to said bucket to immobilize said bucket and prevent pivoting thereof on said lifting arms when said one reciprocating arm is connected to said ram head of said log splitting device.

2. A log splitting device as set forth in claim 1, wherein said rigid immobilizing connecting means includes a first connecting pin to connect said mounting frame of said log splitting device to an underside portion of said bucket whenin said turned-over position, a second connecting pin spaced apart from said first connecting pin to connect said mounting frame to said one of said lifting arms at a first relatively forward end portion thereof, and third connecting means to provide a connection between said mounting frame and said one of said lifting arms at a second portion thereof spaced apart rearwardly from said first relatively forward end portion.

3. A log splitting device as set forth in claim 2, wherein said third connecting means is a connecting pin through said mounting frame and through said lifting arm at said second portion thereof.

4. A log splitting device as set forth in claim 3, wherein said mounting frame includes a pair of side walls straddling said lifting arm when mounted thereon and extending below the bottom edge of said lifting arm, said third connecting means comprising at least one flange extending inwardly from the bottom of one of said side walls and bearing against said bottom edge of said lifting arm when said mounting frame is mounted thereon.

5. A log splitting device as set forth in claim 2, wherein said mounting frame includes an elongated planar work surface extending between said log splitting means at one end and the fully retracted position of said ram head at the other end, and a pair of side walls depending downwardly from said planar work surface to straddle a portion of said one lifting arm when mounted thereon, said track means includes a pair of elongated longitudinal grooves on opposite sides of said mounting frame extending parallel to said planar work surface and closely spaced apart therefrom, said ram head includes a pair of depending side arms to extend from said planar work surface to respective ones of said pair of elongated longitudinal grooves, a glide member extending from each of said depending side arms to seat in respective ones of said elongated longitudinal grooves for sliding movement therealong as said ram head is moved between said retracted and said extended positions.

6. A log splitting device as set forth in claim 5, wherein said log splitting means comprises a wedge member having a cutting edge facing toward said ram head.

7. A log splitting device as set forth in claim 1, wherein said other hydraulically powered reciprocating arm remains connected to said bucket, said other hydraulically powered reciprocating arm being unable to respond because of said rigid immobilizing connecting means when hydraulic pressure is applied by an operator to move said one powered reciprocating arm connected to said ram head of said log splitting device between said retracted and said extended positions, the hydraulic pressure which would otherwise be applied to move the now immobilized hydraulically powered reciprocating arm being diverted to and applied to said one powered reciprocating arm connected to said ram head to increase both the force and speed thereof beyond what they would be if said other hydraulically powered reciprocating arm were not immobilized.

8. A log splitting device as set forth in claim 1, wherein said bucket is pivoted to said turned-over position and lowered to the ground, the overturned bucket serving as a work platform for operation of said log splitting device.

9. A log splitting device as set forth in claim 5, wherein said ram head includes a rearwardly opening recess to receive the forward end of said one powered reciprocating arm therein for connection to said ram head, said one powered reciprocating arm including a coupling head at said forward end thereof, an aperture through said coupling head, an aperture through said ram head opening to said recess in registration with said aperture of said coupling head when it is received into said recess, and a coupling pin through said apertures to couple said ram head to said one powered reciprocating arm.

10. A log splitting device for connection to a powered machine mounted implement which has at least one powered reciprocating arm to manipulate said implement, such reciprocating arm being disconnectible from said implement, said log splitting device including a mounting frame for connection to said powered machine mounted implement, log splitting means on said mounting frame in alignment with said one powered reciprocating arm when said log splitting device is connected to said powered machine mounted implement, said mounting frame including elongated track means extending along said mounting frame at a location between said log splitting means and said one powered reciprocating arm when said log splitting device is connected to said powered machine mounted implement, a ram head slidingly and captively mounted on said track means for reciprocal movement between a retracted position away from said log splitting means and an extended position toward said log splitting means, said ram head being connected to said one powered reciprocating arm to drive said ram head between said retracted and said extended positions, wherein said mounting frame of said log splitting device includes first connecting means to connect said log splitting device to said powered machine mounted implement, said powered machine mounted implement includes second connecting means to cooperatively act with said first connecting means to connect said log splitting device to said powered machine mounted implement, and locator means to align said first and second connecting means prior to connection of said log splitting device to said powered machine mounted implement.

11. A log splitting device as set forth in claim 10, wherein said first and second connecting means include respective apertures, said locator means includes a first formation along an edge of said mounting frame of said log splitting device, a corresponding second formation on said implement to cooperatively engage said first formation when said log splitting device is mounted on said implement, said first and second formations being positioned whereby said apertures of said first and second connecting means are in registration respectively when said first and second formations are cooperatively engaged.

12. A log splitting device as set forth in claim 2, wherein said third connecting means is a connecting pin through a portion of said mounting frame which extends beyond said lifting arm when mounted thereon, said connecting pin lying adjacent a laterally extending outer surface portion of said lifting arm to abut thereagainst and prevent further movement of said connecting pin in the direction toward said lifting arm.

13. A log splitting device for connection to a powered machine mounted implement which has at least one powered reciprocating arm to manipulate said implement, such reciprocating arm being disconnectible from said implement, said log splitting device including a mounting frame for connection to said powered machine mounted implement, log splitting means on said mounting frame in alignment with said one powered reciprocating arm when said log splitting device is connected to said powered machine mounted implement, said mounting frame including elongated track means extending along said mounting frame at a location between said log splitting means and said one powered reciprocating arm when said log splitting device is connected to said powered machine mounted implement, a ram head slidingly and captively mounted on said track means for reciprocal movement between a retracted position away from said log splitting means and an extended position toward said log splitting means, said ram head being connected to said one powered reciprocating arm to drive said ram head between said retracted and said extended positions, wherein said powered machine mounted implement is a tractor mounted end loader having a pair of extending lifting arms for connection normally to a bucket but in which the bucket has been removed, said end loader including a pair of hydraulically powered reciprocating arms each positioned in spaced apart cooperative relationship with respective ones of said pair of lifting arms and each normally connected to said presently removed bucket for pivoting between a turned-upright and turned-over position, said one powered reciprocating arm being one of said pair of hydraulically powered reciprocating arms, and locking means to immobilize said other of said pair of hydraulically powered reciprocating arms to prevent it from reciprocating forward and rearward when said first mentioned hydraulically powered reciprocating arm has hydraulic pressure applied thereto to reciprocate in a forward and rearward direction.

14. A log splitting device as set forth in claim 13, wherein said locking means to immobilize said other of said pair of hydraulically powered reciprocating arms includes a locking member, said locking member including a first connecting assembly to connect the free end of said reciprocating arm thereto, a second connecting assembly to connect thereto the free end of said lifting arm which is in said spaced apart cooperative relationship with said reciprocating arm connected to said first connecting assembly.

15. A log splitting device as set forth in claim 14, wherein said first connecting assembly includes an aperture and pin, and said second connecting assembly includes an aperture and pin, said second connecting assembly also including means to prevent rotational movement of said locking member relative to said free end of said lifting arm.

16. A log splitting device for connection to a powered machine mounted implement which has at least one powered reciprocating arm to manipulate such implement, such reciprocating arm being disconnectible from said implement, said log splitting device including a mounting frame for connection to said powered machine mounted implement, log splitting means on said mounting frame in alignment with said one powered reciprocating arm when said log splitting device is connected to said powered machine mounted implement, said mounting frame including elongated track means extending along said mounting frame at a location between said log splitting means and said one powered reciprocating arm when said log splitting device is connected to said powered machine mounted implement, a ram head slidingly and captively mounted on said track means for reciprocal movement between a retracted position away from said log splitting means and an extended position toward said log splitting means, said ram head being connected to said one powered reciprocating arm to drive said ram head between said retracted and said extended position, including log dislodging means to dislodge a log from said log splitting means in the event it fails to completely split.

17. A log splitting device as set forth in claim 16, wherein said log dislodging means includes a hook to engage the forward end of a log lodged against said log splitting means for rearward movement of said log, and hook connecting means to connect said hook to said powered machine mounted implement for powered movement of said hook in a rearward direction to move said log in said rearward direction to dislodge from said log splitting means.

18. A log splitting device as set forth in claim 17, wherein said hook connecting means includes an elongated shaft integrally connected at a first end to said hook, log dislodging bracket means mounted on said mounting frame to slidably carry said elongated shaft and hook between a forward position for engagement with a lodged log and a rearward dislodged position, said elongated shaft including drive connecting means at its opposite second end for connection to said powered reciprocating arm.

19. A log splitting device as set forth in claim 18, wherein said drive connecting means includes a laterally extending arm integrally connected to said second end of said elongated shaft, and receiving means on said ram head connected to said powered reciprocating arm to receive the free end portion of said laterally extending arm and engage therewith for rearward powered movement of said log dislodging means when said ram head is moved rearwardly by said powered reciprocating arm.

20. A log splitting device as set forth in claim 19, wherein said hook comprises a laterally extending arm member integrally connected to said first end of said elongated shaft, said hook and said arm connected to said second end of said shaft both extending laterally therefrom in substantially the same direction and in substantially the same plane, said bracket means including an elongated tubular member mounted on said mounting frame of said log splitting device through which said elongated shaft is slidingly received, said elongated shaft being rotatable within said tubular member to rotate said hook and said arm between a first position for engagement respectively of said hook with a log and of said arm with said ram head and a second position wherein said hook and said arm are rotated out of said respective engagement positions.

* * * * *